US005787820A

United States Patent [19]

Dittoe

[11] Patent Number: 5,787,820

[45] Date of Patent: Aug. 4, 1998

[54] HAND HELD PROTECTIVE SHIELD DEVICE

[76] Inventor: Thomas D. Dittoe, 1524-51st Pl. SW., Everett, Wash. 98203

[21] Appl. No.: 762,210

[22] Filed: Dec. 9, 1996

[51] Int. Cl.[6] ..... E06B 9/00; F41H 5/08

[52] U.S. Cl. ..... 109/49.5; 2/2.5; 89/36.05

[58] Field of Search ..... 109/49.5; 2/2.5, 2/16; 446/473; 89/36.01, 36.02, 36.05; D22/199

[56] References Cited

U.S. PATENT DOCUMENTS

| | | | |
|---|---|---|---|
| D. 132,468 | 5/1942 | Leuer | 2/2.5 |
| 1,250,197 | 12/1917 | Louppe | 109/49.5 |
| 1,279,571 | 9/1918 | Moloney | 2/2.5 |
| 1,438,109 | 12/1922 | Hale | 2/2.5 |
| 1,895,197 | 1/1933 | Martinson | 109/49.5 |
| 3,370,302 | 2/1968 | Karlyn | 2/2.5 |
| 3,766,865 | 10/1973 | Cutler | 109/49.5 |
| 3,848,547 | 11/1974 | Schaefer | 89/36.05 |
| 3,866,242 | 2/1975 | Slagel | 89/36.02 |
| 4,674,394 | 6/1987 | Martino | 2/2.5 |
| 4,843,947 | 7/1989 | Bauer et al. | 109/49.5 |
| 5,056,155 | 10/1991 | Truxell | 109/49.5 |
| 5,241,703 | 9/1993 | Roberts et al. | 109/49.5 |
| 5,641,934 | 6/1997 | Follet | 89/36.05 |

OTHER PUBLICATIONS

"Popular Science" Jun. 1954, p. 131.

Pro–Tech Armored Products for Law Enforcement Catalog.

*Primary Examiner*—Darnell M. Boucher

*Attorney, Agent, or Firm*—Jensen & Puntigam, P.S.

[57] ABSTRACT

A hand held protective shield (FIG. 1) constructed of clear impact resistant plastic sheet material which is thermo-vacuum formed to provide a recess (15) to support the human forearm and provide rigidity to said shield. A handle (12) is mounted in said recess by a means which positions said handle perpendicular in relation to the surface of said shield. The positioning of said handle allows the operator (FIG. 3) to control said shield by applying a slight wrist moment (19) to said handle. This serves to secure said shield against the forearm while not being attached to the arm by any means. Said shield is then utilized for protection while securing a handcuffed prisoner in a vehicle seat belt.

6 Claims, 4 Drawing Sheets

HAND HELD PROTECTIVE SHIELD DEVICE

BACKGROUND—FIELD OF INVENTION

This invention relates to the field of law enforcement, specifically to a safety device to protect officers from attack while securing handcuffed prisoners in a vehicle seat belt.

BACKGROUND—DESCRIPTION OF PRIOR ART

Law enforcement officers are frequently required to secure prisoners in a seat belt during the performance of their duties. This act places them in a vulnerable position as they reach across the seated prisoner to fasten or release the seat belt. Officers are vulnerable to head strike type attacks and communicable disease through the transfer of bodily fluids if the prisoner bites or spits on the officer.

The solution to this problem most often used by officers is to refuse to secure the prisoner in a seat belt. While this reduces the risk to the officer, it serves to increase the risk to the prisoner. A prisoner handcuffed behind the back and not secured in a seat belt is more likely to be injured in the event of an accident. The prisoners are also unable to use their hands to protect themselves in the event of a sudden stop.

Current products approach a solution by altering the seat belt system to make it more accessible or by covering the prisoner's head with a hood type device. These devices offer partial protection or only expedite the seat belting process. The officer is still vulnerable to attack or body fluids while securing the seat belt. The use of a fabric hood may make it difficult for a prisoner to spit, but will not stop a bite or other attack from the head. Likewise, the after market seat belt systems do not offer the officer protection from body fluids or aggressive individuals.

Shield type devices have been utilized in law enforcement applications for years. Large shields and some smaller types have long been used as protection during riots. These shields typically utilize a loop type handle and strap to secure the shield to the officer's arm, or two loop type handles to hold the shield in front of the officer. The law enforcement shields heretofore known suffer from the following disadvantages:

(a) The shields are too large to be employed in the rear seat area of a patrol car and no shields heretofore known are designed for use while securing prisoners in a seat belt.

(b) The shields requiring two hands to operate are designed for riot or prisoner control. They can not be used with one hand.

(c) Shields that utilize a loop handle and strap require the shield to be fastened to the officer's arm during use. An officer may need to hold the shield in the right or left hand depending on the side of the vehicle the prisoner was seated. This would require the officer to secure the shield to their dexterous arm and hand in some situations. The officer would be forced to remove the shield from their arm prior to drawing a firearm or other protective weapon if a threat were encountered.

OBJECTS AND ADVANTAGES

Accordingly, several objects and advantages of my invention are:

(a) To provide a shield with a clear impact resistant body to allow the officer to monitor the prisoner during use.

(b) To provide a shield of a size which can be used in the confined spaces of the back seat of a patrol vehicle.

(c) To provide a shield of a size which will protect the officer from the head area of the prisoner.

(d) To provide a shield which is contoured to provide a recess for the users hand and forearm.

(e) To provide a shield which can be operated with one hand without being secured to the arm.

Further objects and advantages will become apparent from a consideration of the ensuing description and drawings.

DRAWING FIGURES

REFERENCE NUMBERS IN DRAWINGS

Figure 1:
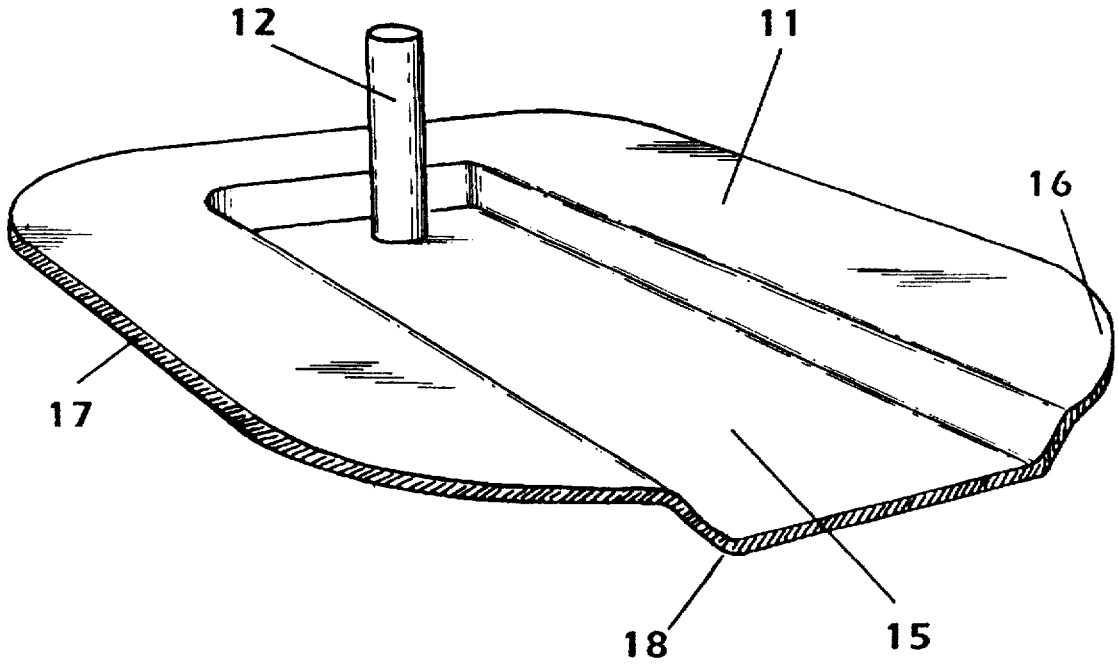
FIG. 1 shows the shield assembly from a rear corner perspective.

11 shield body
12 handle
13 fastener
14 hole
15 recess
16 edge corner
17 edge
18 surface corner
19 wrist moment

DESCRIPTION—FIG. 1 TO 6

Figure 2A:
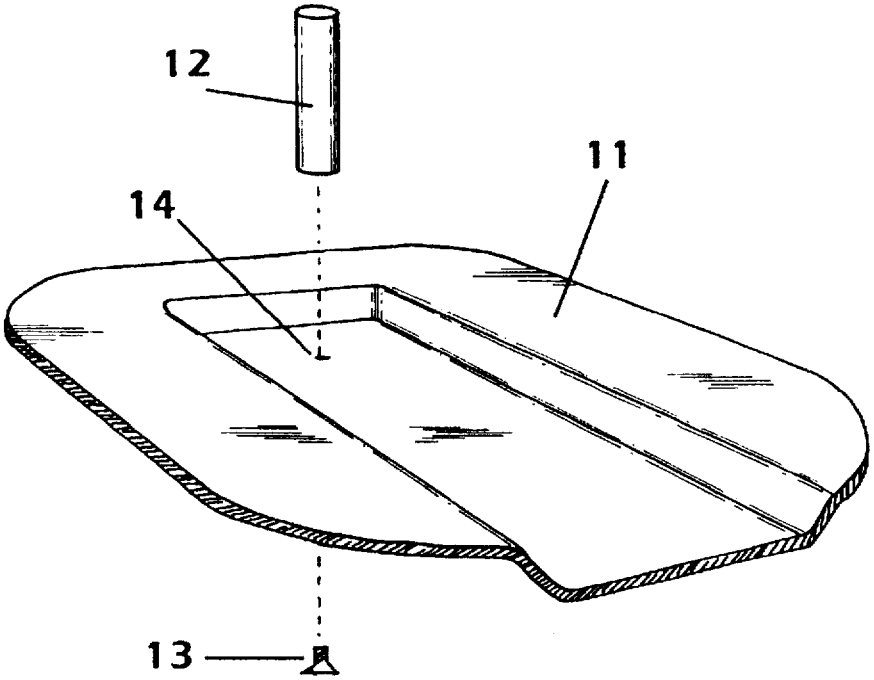
FIG. 2A shows an exploded view of the assembly.
Figure 2B:
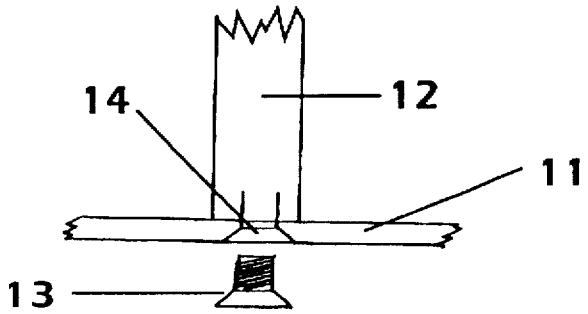
FIG. 2B shows an exploded view detail of handle installation.
Figure 3:
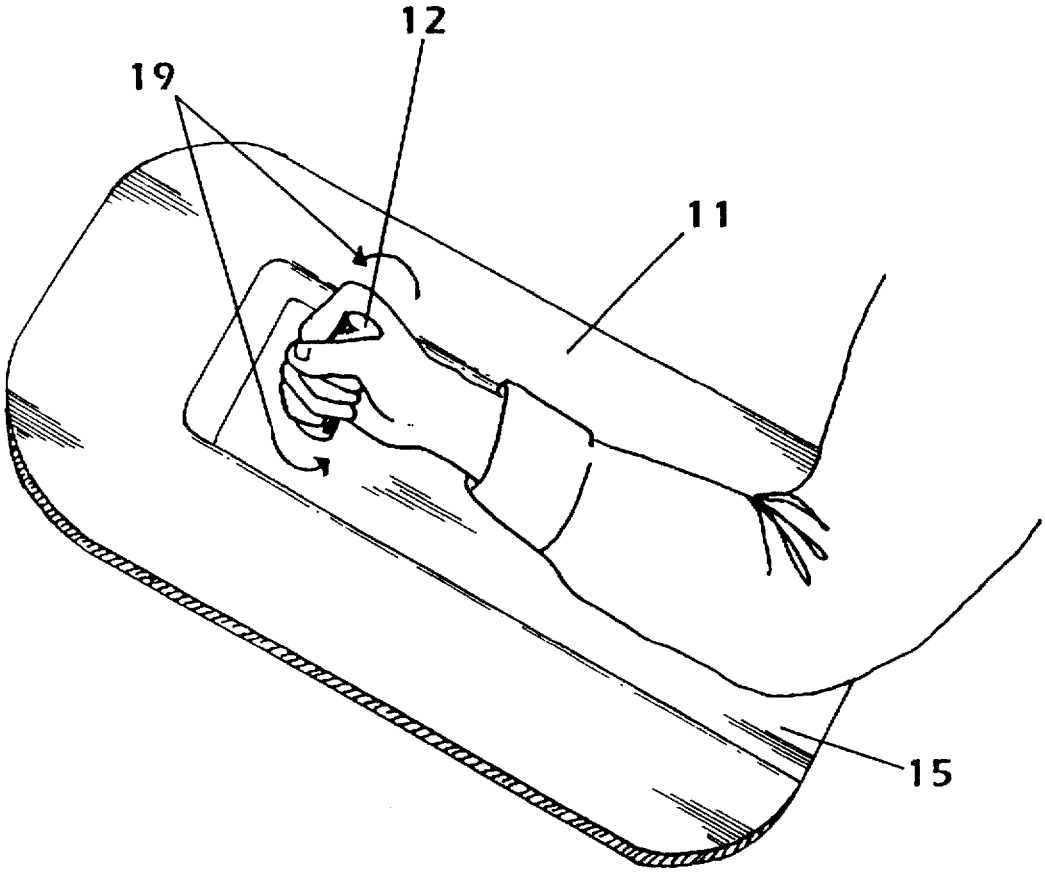
FIG. 3 is a view which shows operation.
Figure 4A:
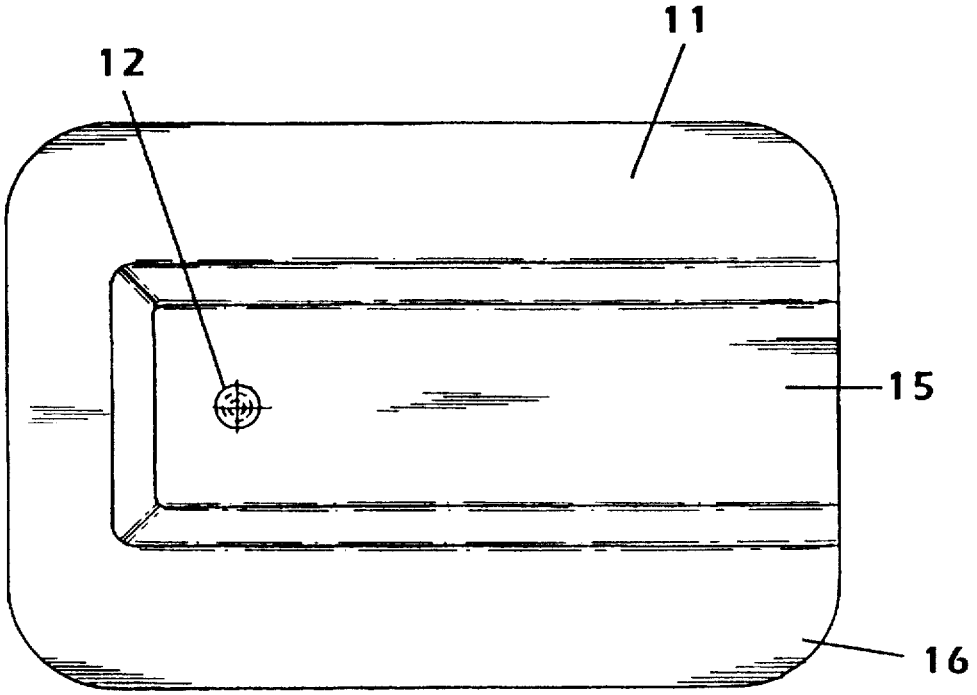
FIG. 4A is a top view of the assembly.
Figure 4B:
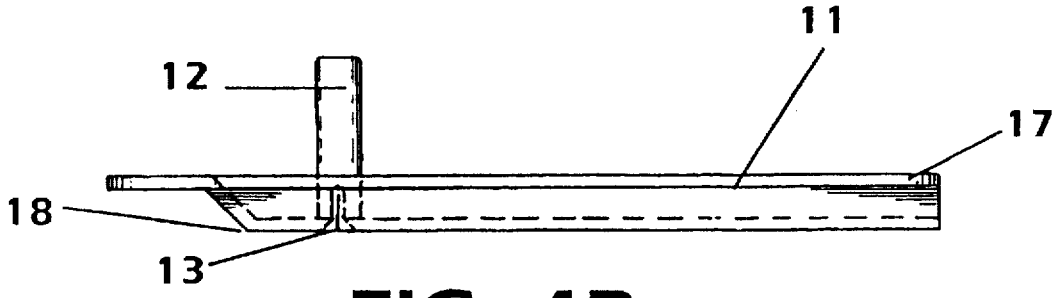
FIG. 4B is a side view of the assembly.

A typical embodiment of the shield of the present invention is illustrated in FIG. 1 (rear corner perspective). A typical assembly is shown in FIGS. 2A and 2B (exploded views) and FIGS. 4A and 4B (top and side views respectively). A shield body 11 is constructed of a clear polycarbonate sheet material which is impact resistant and readily available through several manufacturers. Shield body 11 has a recess 15 which is thermo-vacuum formed, a common method of shaping plastics. Shield body 11 is typically 0.48 cm (3/16 in) in thickness and has overall dimensions of roughly 35.6 cm (14 in) ×50.8 cm (20 in). Recess 15 is roughly 17.8 cm (7 in)×43.2 cm (17 in) and begins roughly 7.6 cm (3 in) back from the forward edge and continues to the rear edge. Recess 15 is approximately 2.5 cm (1 in) deep and is formed with the sides at roughly a 45 degree angle. All 45 degree angles result in a radiused surface corner 18 (FIGS. 1 and 4B) on shield body 11. An edge 17 is peripheral and is rounded to avoid personal injury and snagging. All edge corners 16 (FIGS. 1 and 4A) have roughly a 6.4 cm (2.5 in) radius.

A handle 12 is constructed from aluminum rod 2.5 cm (1 in) diameter and is roughly 10.2 cm (4 in) tall. The diameter of handle 12 is knurled to provide grip and the top edge is rounded to avoid personal injury. The bottom of handle 12 is center-drilled and tapped to receive a fastener 13 (FIGS. 2A, 2B). Fastener 13 is typically a 0.79 cm (5/16 in)×1.9 cm (3/4 in) fine thread machine screw with a 100 degree countersunk head Fastener 13 is commonly found in aviation applications and is referenced under standard part number NAS517-5-4. Handle 12 is attached perpendicular to the surface of shield body 11 using fastener 13. Fastener 13 passes though a hole 14 (FIGS. 2A and 2B) which is drilled to a diameter of roughly 0.79 cm (5/16 in). Hole 14 is countersunk at 100 degrees to a depth roughly 0.32 cm (1/8 in) to flush the head of the fastener to avoid personal injury and snagging. Hole 14 is located roughly 7.6 cm (3 in) back from the forward edge of recess 15 and centered in relation to the sides of recess 15.

From the description above, a number of advantages of my shield having a perpendicular handle become evident:

(a) The size of the shield allows for ease of use in the rear seat area of a patrol car.

(b) The clear impact resistant body allows an officer to visually monitor the prisoner while using the shield. It also provides the officer with the necessary protection from possible attack.

(c) The perpendicular handle and recess provide positive one hand control of the shield without the need for further straps or devices to fasten the shield to the officer's hand. The recess also serves to make the shield more rigid.

(d) The elimination of straps (or other devices) to attach the shield to the officer's arm allows for the officer to instantly discard the shield if the operating hand is needed for an urgent purpose such as drawing a firearm.

(e) The rounded corners and edges as well as the countersunk fastener reduce the risk of personal injury to the officer and prisoner.

(f) Operation is ambidextrous and permits use from either side of the officer's patrol vehicle.

OPERATION—FIG. 3

The manner of using the shield with a perpendicular handle is different from that of shields presently in use. One first grasps handle 12 with shield body 11 positioned so that the users forearm rests in recess 15. Handle 12 allows for ambidextrous use and the operating hand is always that closest to the prisoner. For example, the operating hand would be the right hand when entering the left side of the vehicle and the left hand when entering the right side of the vehicle. The user exerts a small wrist moment 19 on handle 12 which serves to retain shield body 11 against the forearm. Shield body 11 is positioned between the officer and prisoner while the officer uses the free hand to fasten the seat belt around the prisoner. The seat belt is positioned between shield body 11 and the prisoner during the process to avoid snagging. Shield body 11 is held in a manner to place the prisoner's upper body and head behind it and protect the officer during the entire seat belt process.

SUMMARY, RAMIFICATIONS, AND SCOPE

Accordingly, the reader will see that the clear impact resistant shield of this invention utilizing a perpendicular handle is easily and naturally operated. It also serves to provide effective protection for an officer while securing a prisoner in a vehicle seat belt. Furthermore, it has the additional advantages in that

- it permits the officer to monitor the prisoner during use;
- it is a size which can be used in the confined spaces of the back seat of a patrol vehicle;
- it is a size which will protect the officer from the head area of a prisoner;
- it provides a recess for the users forearm which enhances the control provided by the perpendicular handle;
- it can be operated with one hand without being secured to the arm, allowing the officer to instantly discard the shield if necessary.

Although the description above contains many specificities, these should not be construed as limiting the scope of the invention but as merely providing illustrations of some of the presently preferred embodiments of this invention. For example, the shield can be of a different size or shape to be better used in a different application; the handle can be constructed of a different material and grip design; the handle can be attached in such a way that it folds to facilitate storage; the recess can have other shapes; padding or non-slip material can be added to the recess and shield body; etc.

Thus the scope of the invention should be determined by the appended claims and their legal equivalents, rather than by the examples given.

I claim:

1. A one-handed hand-held protective shield, comprising:

a rigid, impact-resistant shield body, having upper and lower edges and opposing lateral edges;

a rod-like handle element having one end thereof secured to the shield body approximately midway between the opposing lateral edges of said shield body and near the upper edge thereof, the rod-like handle element extending substantially perpendicularly from the shield body, such that when a user grips the handle with one hand, the grip axis of said hand is substantially perpendicular to the shield body and a lower edge of said hand lies adjacent a rear surface of the shield body; and a recess in the rear surface of the shield body, said recess being located approximately midway between the opposing lateral edges of the shield body, said recess extending approximately from the lower edge of the shield body a substantial distance toward the upper edge of the shield body, the recess being wide enough and long enough to accommodate a forearm of a user.

2. An article of claim 1, wherein the shield body is made from clear plastic.

3. An article of claim 1, wherein the handle element terminates in a free end and wherein the handle element extends just beyond the width of a user's fist.

4. An article of claim 1, wherein the shield body has a size which protects substantially only the head and neck regions of the user.

5. An article of claim 1, wherein the handle element is located in the recess, near an upper end thereof.

6. An article of claim 1, wherein the shield body has a peripheral edge with rounded corners and wherein the recess includes an angled portion connecting said recess with the remainder of the shield body.

* * * * *